United States Patent [19]

Tsunoi et al.

[11] 4,192,229

[45] Mar. 11, 1980

[54] FIXING APPARATUS

[75] Inventors: Haruo Tsunoi, Kawasaki; Teruo Morikawa, Sagamihara; Katsuhiko Yamada, Yokohama; Kenji Ohkawara, Koshigaya; Atsushi Kubota, Tokyo, all of Japan

[73] Assignee: Canon Kabushiki Kaisha, Tokyo, Japan

[21] Appl. No.: 946,756

[22] Filed: Sep. 28, 1978

[30] Foreign Application Priority Data

Oct. 7, 1977 [JP] Japan ..... 52-120738
Dec. 5, 1977 [JP] Japan ..... 52-145932

[51] Int. Cl.[2] ..... B30B 3/04

[52] U.S. Cl. ..... 100/158 R; 100/160; 100/162 B; 432/60; 219/216; 219/469; 355/3 FU

[58] Field of Search ..... 100/155–176; 219/469–471, 216, 388, 244; 156/580, 582; 432/60; 355/3 FU; 101/153, 152; 118/60, 70, 101; 68/257, 258

[56] References Cited

U.S. PATENT DOCUMENTS

| | | | |
|---|---|---|---|
| 2,212,820 | 8/1940 | Barber | 101/153 |
| 3,309,984 | 3/1967 | Mackay | 101/23 X |
| 3,736,869 | 6/1973 | Motter et al. | 101/153 |
| 3,880,577 | 4/1975 | Tomono et al. | 432/60 |
| 3,884,623 | 5/1975 | Slack | 432/60 |
| 3,945,726 | 3/1976 | Ito et al. | 219/216 |
| 4,022,122 | 5/1977 | Moser et al. | 100/158 R |
| 4,104,963 | 8/1978 | Fortmann | 100/176 |

FOREIGN PATENT DOCUMENTS 51-40351 6/1976 Japan .

*Primary Examiner*—Peter Feldman
*Attorney, Agent, or Firm*—Fitzpatrick, Cella, Harper & Scinto

[57] ABSTRACT

Apparatus for fixing toner image on a toner image supporting member in electrophotographic copying machine is disclosed. The fixing apparatus includes three rotary rollers which are in contact with each other under the action of pressing means. One of the three rollers has a smaller diameter than the other two rollers. Two rollers with which the toner image supporting member comes into contact are disposed in such a manner that the axes of the two rollers intersect each other and the portion at which the two rollers contact each other or are closest to each other forms a straight line relative to the direction of roller axis. According to one embodiment of the invention, the remaining one roller with which the supporting member does not contact, is formed as a crown roller, that is, a roller which has its largest diameter at the middle portion of the roller.

20 Claims, 18 Drawing Figures

FIXING APPARATUS

BACKGROUND OF THE INVENTION

1. Field of the Invention

The present invention relates to a fixing apparatus for use in electrostatic copying or printing machines.

2. Description of the Prior Art

Hitherto, the heat fixing method has been used most widely in electrophotographic copying or printing machines. According to the heat fixing method, a toner image electrostatically adhered to the surface of a supporting member such as a sheet of paper is fused with heat to permanently fix the toner image on the supporting member.

However, it has been found that such a heat fixing method has various drawbacks. Firstly, it needs a large quantity of electric power for the heat source. The quantity of electric power consumed in this heat fixing station reaches about 70–80% of the total power consumption by the whole copying machine. Secondly, it takes a relatively long time to warm up the fixing apparatus. Therefore, it is impossible to start a copying operation immediately after the power source of the copying machine is switched on. Lastly, heat emitted from the fixing apparatus has an adverse effect on the characteristics of the photosensitive medium and/or developer. The whole copying machine suffers from the heat emitted from the fixing apparatus and there occurs a change in the characteristics of the photosensitive medium and/or developer which in turn reduces the efficiency and effective life thereof. In the worst case, there may occur a serious problem of the supporting member catching fire when it becomes jammed in the fixing apparatus.

Due to the above mentioned drawbacks involved in heat fixing method, nowdays there is an increased tendency to use the pressure fixing method instead of the heat fixing method. According to the pressure fixing method, toner particularly prepared for the pressure fixing method is adhered onto a supporting member to form a toner image and the supporting member carrying thereon the toner image is passed between a pair of rollers contacting with each other under high pressure so as to fix the toner image with pressure.

A typical example of pressure fixing apparatus according to the prior art is shown in FIG. 1. Designated by P is a supporting member carrying thereon a toner image. Fixing of the toner image is effected between a pair of rollers 1 and 2 under pressure. The necessary pressure is given by a pressing mechanism 3 which brings the two rollers 1 and 2 into contact with each other under a high pressure. One of the rollers which contacts with the image side surface of the supporting member P, that is, the roller 1 is made of metal. The other roll which contacts the backside surface of the supporting member P, that is, the roller 2 is made as an elastic roller by covering the surface of the roller with elastic material. As an alternative, both of the rollers 1 and 2 may be made as rigid metal rollers. In this case, the two metal rollers 1 and 2 are disposed in such manner that the one roller intersects the other.

The pressure fixing apparatus comprising a metal roller and an elastic roller has such disadvantage that the maximum pressure which the fixing rollers can apply to the toner image supporting member is limited by the kind of material used for the elastic roller. Therefore, it is impossible to apply a high pressure to this type of the fixing rollers. Moreover, the elastic roller is easily damaged by toner and carrier.

For the latter mentioned type of pressure fixing apparatus comprising two rigid metal rollers, it is possible to apply a high contact pressure. Nevertheless, it has some drawbacks in practical use. The fixing roller is required to have a larger diameter in order to apply onto the surface of the supporting member a load (pressure) more than the critical pressure necessary for sufficiently fixing the toner image. When this requirement is satisfied, the apparatus inevitably becomes large in size and heavy in weight as a whole. This will also have an unfavourable effect on the fixability of the toner image. Moreover, if the two metal rollers which must be arranged intersect each other as previously noted have different diameters, then there will arise a problem of creasing in the supporting member. This problem of creasing becomes remarkable particularly when a supporting member of larger size in width is used.

We, the inventors of the present invention have carried out a number of experiments on the pressure fixing apparatus. These inventive experiments have led us to the finding that an important factor affecting the pressure fixability of toner image is the maximum pressure per unit area (Po) rather than the total pressure exerted on the nip portion between the pair of rollers (Wo). In other words, it has been found that the local maximum pressure Po has a greater effect on the pressure fixability of the toner image than the total pressure Wo does.

As seen in FIG. 2, the conventional pressure fixing apparatus can not produce a high local maximum pressure Po even when the total pressure Wo is increased. The rollers 1 and 2 shown in FIG. 2 have a larger diameter Ro. A toner image supporting member P is nipped in between the two rollers and there is formed a nip width (angle $\alpha$). As will be easily understood, the nip width will become broader with the increase of the roller diameter Ro. Therefore, the increase of the total pressure Wo can not bring about the corresponding increase of the value of Po (maximum pressure per unit area). The increase of the value Po is relatively small or the value of Po remains unchanged as compared with the increase of the total pressure Wo. For this reason, in the case of the conventional pressure fixing apparatus, no substantial improvement in pressure fixability can be attained by increasing the total pressure Wo.

SUMMARY OF THE INVENTION

Accordingly, it is a general object of the present invention to eliminate the above mentioned disadvantages and drawbacks involved in the pressure fixing apparatus according to the prior art.

More specifically, it is an object of the invention to provide a fixing apparatus which enables the application of a higher load onto a toner image supporting member.

It is another object of the invention to provide a fixing apparatus which improves the fixability of the toner image in proportion to the increase of total pressure and which is small in size and light in weight.

It is a further object of the invention to provide a fixing apparatus which assures a uniform application of pressure on a toner image supporting member while preventing crease formation in the supporting member and irregular fixing of the toner image on the supporting member.

Other and further objects, features and advantages of the invention will appear more fully from the following description taken in connection with the accompanying drawings.

DETAILED DESCRIPTION OF THE PREFERRED EMBODIMENTS

Figure 3:
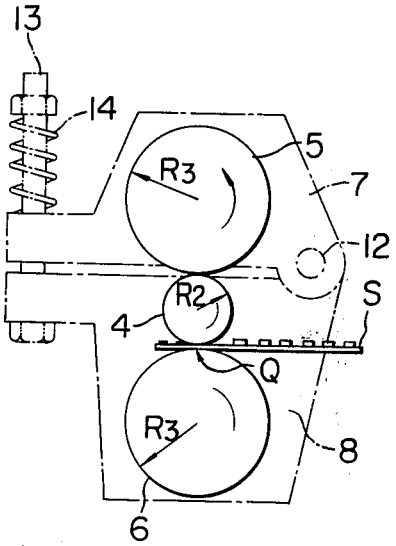
FIG. 3 shows an embodiment of a fixing apparatus according to the invention.

The first embodiment of fixing apparatus according to the present invention is shown in FIG. 3. The fixing apparatus comprises three rollers, a first roller 4 and two pressing rollers 5 and 6 in contact with the circumferential surface of the first roller 4. These rollers are made from hard metal material such as iron and the diameter of the first roller 4 is smaller than those of the two pressing rollers 5 and 6. The diameter of the pressing roller 5 and that of the pressing roller 6 may be the same or different. However, when the two pressing rollers are made from the same material and have the same structure, they have preferably the same diameter.

Figure 5:
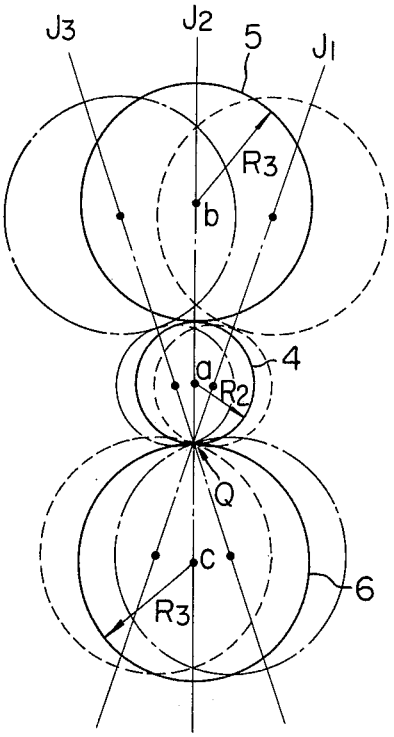
FIG. 5 is a sectional view of the apparatus shown in FIG. 3, taken along a plane intersecting the axes of the rollers.

As seen best in FIG. 5, the pressing rollers 5 and 6 are disposed relative to the first roller 4 in such a manner that the three centers (centers of axes) a, b and c of the rollers 4, 5 and 6 in any cross section thereof always lie on a straight line $J_2$ passing through the contact portion Q between the first roller 4 and the lower pressing roller 6 and that the axis of the pressing roller 6 intersects the axis of the first roller 4. In other cross section of the rollers indicated by the broken line and by the chain-dotted line in FIG. 5, the three centers of the rollers 4, 5 and 6 lie on the straight lines $J_1$ and $J_3$ respectively which also pass through the contact portion Q. Thus, in FIG. 5, the centers of axes of the three rollers 4, 5 and 6 lie on the straight line $J_1$ at their ends on one side (on the front side as viewed in the drawing of FIG. 5), on the straight line $J_2$ at their central parts and on the straight line $J_3$ at their another end portions (on the rear side as viewed in the drawing) respectively.

Figure 4:
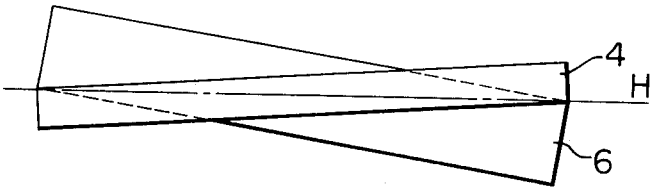
FIG. 4 is an illustration explaining the manner in which the first roller contacts with the lower pressing roller.

FIG. 4 shows the manner of contact between the first roller 4 and the lower pressing roller 6. As seen in FIG. 4, the axis of the roller 4 and the axis of the roller 6 intersect each other at a certain angle. As viewed in the direction of roller axis, the contact portion Q at which the two rollers 4 and 6 contact with each other or are closest to each other, forms a straight line H. This particular arrangement of the two rollers relative to each other constitutes an important feature of the present invention.

In the shown embodiment, the first roller 4 and the lower pressing roller 6 with which a toner image supporting member comes into contact when fixing is effected, are in direct contact with each other. But, the two rollers may be spaced from each other to provide a gap therebetween so that they can contact with each other indirectly through the supporting member. Therefore, for the purpose of the present invention, the term "the contact portion between the first roller and the one pressing roller" should be understood to include both the case of direct contact and that of indirect contact through the supporting member.

Figure 7:
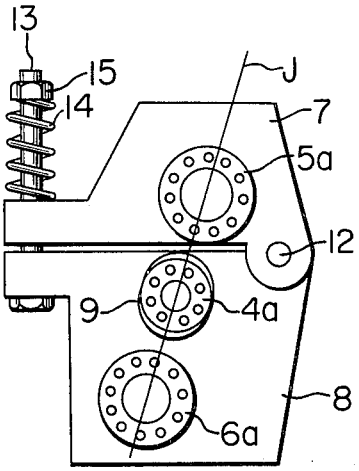
FIG. 7 is a side view thereof.
Figure 6:
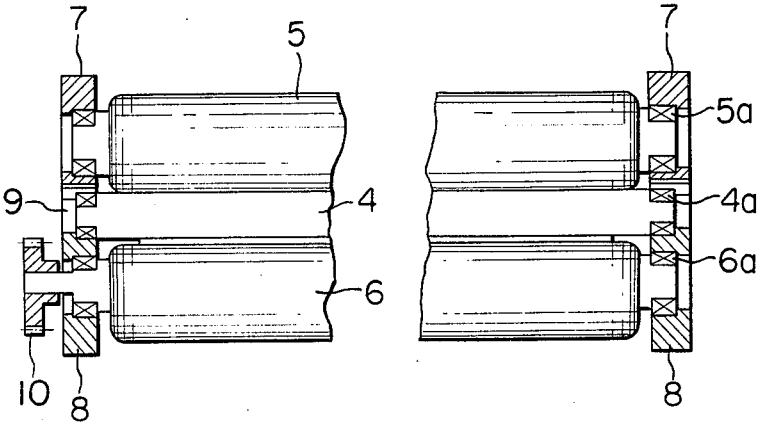
FIG. 6 is another section thereof taken along a plane extending along the axes of the roller partially cut away.

As seen best in FIGS. 6 and 7, the upper pressing roller 5 is rotatably mounted on a pair of upper supporting plates 7 through a bearing 5*a* and the lower pressing roller 6 is rotatably mounted on a pair of lower supporting plates 8 through a bearing 6*a*. The first roller 4 is mounted on the lower support 8 rotatably through a bearing 4*a*. As described above, these three rollers 4, 5 and 6 are disposed in such a manner that when they are under pressure, the centers of these three rollers in any cross section thereof always lie on one straight line J.

This particular arrangement of three rollers brings forth particular advantages. Since the line binding the three centers of the rollers 4, 5, 6 forms a straight line, the load on the supporting member S can be distributed uniformly over the surface. Moreover, when the first roller 4 is sandwiched in between the two pressing rollers 5 and 6, the above described feature of the arrangement effectively serves to prevent the first roller 4 from slipping out from its position or being bent by shock at the time when the toner image supporting member S comes in or comes out from the roller.

In order to make it possible to apply onto the supporting member S an equally distributed load without failure, the first roller 4 mounted on the supporting plate 8 is movable slightly also in the direction parallel to the straight line J. To this end, as seen in FIGS. 6 and 7, the lower supporting plate 8 has an opening 9 passing through the plate in the direction of the straight line J. The bearing 4*a* for the first roller is received within the opening 9 and slightly movable in the direction of the straight line J within it.

The toner image supporting member S which may be a sheet of paper having a toner image thereon is fed into the nip between the first roller 4 and the lower pressing roller 6 with its toner image side being in contact with the first roller.

At the one end of the axis of the lower pressing roller 6 there is provided a driving gear 10 (FIG. 6) operatively connected to a driving source. When the driving gear 10 is driven by a motor, the pressing roller 6 rotates and therefore the rollers 4 and 5 are also driven into rotation through the pressing roller 6. The driving gear may be provided at the one end of the first roller 4 alternatively.

The two supporting plates 7 and 8 are supported by a common shaft 12 and pivotally movable about the shaft.

Each free end of the supporting plates has a bore through which a bolt 13 passes. A coil spring 14 is disposed around the bolt 13 on which a nut 15 is screwed. The spring force of the coil spring 14 can be adjusted by screwing in or out the nut 15 on the bolt 13. Bolt 13, spring 14 and nut 15 constitute a pressing mechanism for bringing the rollers into pressure contact with each other. When the upper and lower supporting plates 7 and 8 are moved toward each other up to a closed position by the pressing mechanism as shown in FIG. 7, the three rollers 4, 5 and 6 are brought into a pressure contact relation. In this position, the gear 10 is driven to rotate the rollers and a toner image supporting member S is fed into the nip portion between the rollers 4 and 6 so as to fix the toner image on the supporting member. As described above, the contact pressure between these rollers is adjustable by means of the nut 15.

Now, referring to FIGS. 7 and 8, the effect of the present invention will be described.

As previously noted, an important factor which affects the pressure fixability of toner image is the local maximum pressure per unit area at the nip portion rather than the total pressure exerting on the rollers. To demonstrate the effect of the invention, the nip width and the maximum pressure at the nip portion were measured by experiment and calculations using the fixing apparatus shown in FIG. 3. The result is shown in FIG. 9. For the purpose of comparison, similar experiment and calculation were conducted using the fixing apparatus according to the prior art shown in FIG. 1. The result is shown in FIG. 8 similarly. For the calculation, the following equation was employed:

$$P\max = 0.6\sqrt{WE/R}$$

wherein, W is linear pressure, E is the elastic modulus of the toner image supporting member in the longitudinal direction and R is the radius of the toner.

Figure 1:
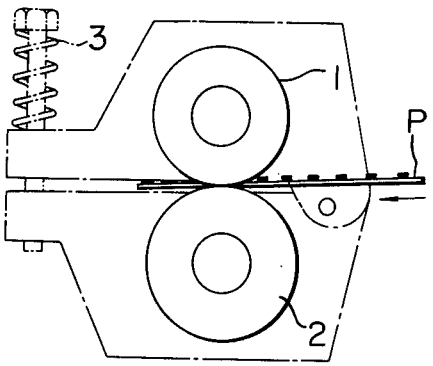
FIG. 1 PRIOR ART
FIG. 1 is a schematic view of a fixing device according to the prior art.
Figure 2:
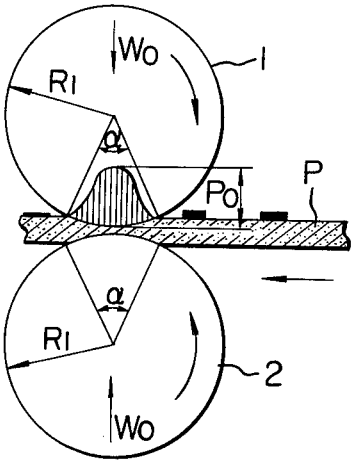
FIG. 2 PRIOR ART
FIG. 2 is an illustration explaining the pressure applied to a fixing device according to the prior art.

As the toner image supporting member S, copy papers of the same kind were used for both the apparatus of FIG. 1 and the apparatus of FIG. 3. Also, the same toner, rollers made of the same hard metal material and the same copy paper feeding speed were used for the experiments.

Figure 8:
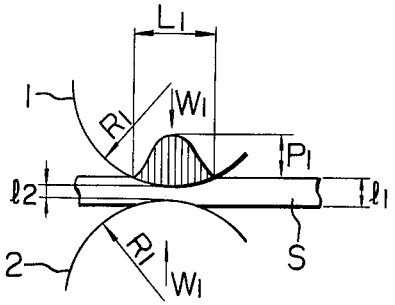
FIG. 8 shows the distribution of the pressure applied to the apparatus shown in FIG. 1.
Figure 9:
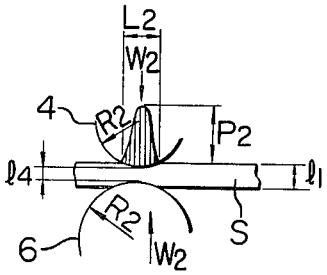
FIG. 9 shows the distribution of the pressure applied to the apparatus shown in FIG. 3.

In FIG. 8, the radius $R_1$ of each of the rollers 1 and 2 was 30 mm, the total pressure $W_1$ was 40 kg/cm$^2$ (as linear pressure), the thickness of copy paper before pressing $l_1$ was 80$\mu$ and the thickness during pressing $l_2$ was 30$\mu$. Under these conditions, the nip width (that is the width of the deformed portion of the copy paper nipped between the two rollers) $L_1$ was found to be 2.2 mm and the local maximum pressure $P_1$ was found to be 220 kg/cm$^2$.

In contrast with the above, in case of the present invention shown in FIG. 9 there was found that the nip width $L_2$ was 1.3 mm and the local maximum pressure $P_2$ was 270 kg/cm$^2$ under the conditions of the radius $R_2$ of the first roller 4=10 mm, the radius $R_3$ of each of the pressing rollers 5 and 6=20 mm, the total pressure $W_2$=20 kg/cm$^2$ (linear pressure) and the thickness of copy paper during pressing $l_3$=30$\mu$.

It is evident from the above results that the fixing apparatus according to the invention enables application of a larger load onto the supporting member with a smaller total pressure as compared with the prior art apparatus and therefore a better fixability can be obtained with the apparatus according to the invention.

In the above described experiments, it was also found that the thickness of copy paper was reduced to 60$\mu$ when measured immediately after pressure fixing for the prior art apparatus whereas the thickness of copy paper for the apparatus according to the invention was 65$\mu$. This difference is attributable to the difference of nip width. As shown above, the nip width in the apparatus according to the invention was 1.3 mm whereas that in the prior art one was 2.2 mm. The nip width in the former is smaller by 40% than that in the latter. Therefore, for the same transportation speed of copy paper, the time during which pressure is applied onto the copy paper is shortened with the apparatus according to the invention. This in turn serves to lessen changes in quality of copy paper usually caused by the high pressure during fixing such as loss of elasticity of fibers and sticking together of fibers in the copy paper. In this manner, when pressure fixing is carried out with the apparatus according to the invention, the copy paper after fixing can maintain its resiliency, good surface appearance and softness. In addition, creasing of the copy paper is avoided during the time when the copy paper passes through the two rollers disposed intersecting each other. A stable transportation of copy paper and a uniform fixing of the toner image are assured by employing the fixing apparatus according to the invention.

FIGS. 10 to 18 show other embodiments of the present invention wherein members and parts having the same function and structure as those in the first embodiment are designated by the same reference numerals and characters as used in the first embodiment.

Figure 10:
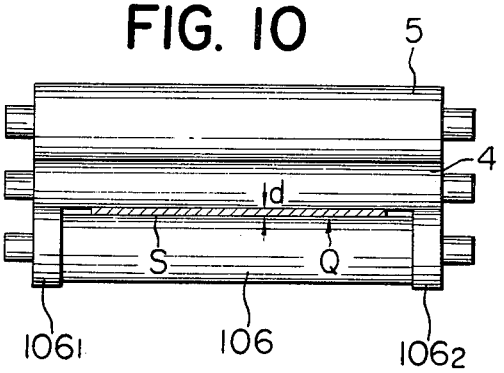
FIGS. 10 to 13 show other embodiments of the invention.

In the embodiment shown in FIG. 10, the lower pressing roller 106 has flange portions $106_1$ and $106_2$ at both ends of the roller. Each flange portion has an enlarged diameter as compared to the central portion of the roller so as to provide a space d between the pressing roller 106 and the first roller to accommodate the toner image supporting member S passing through therebetween. The size of the space d is so measured as to be larger than the particle size of toner but smaller than the thickness of the supporting member deformed by the pressure during fixing.

To apply an uniformly distributed load on the area between the rollers 4 and 106 and also to prevent the supporting member S from being creased, the three rollers 4, 5 and 106 are disposed in the same manner as in the above described first embodiment. Therefore, like the first embodiment, the contact portion at which the first roller 4 and the lower pressing roller 106 contact with each other indirectly through the image supporting member S, forms a straight line as viewed in the direction of the roller axis.

Figure 11:
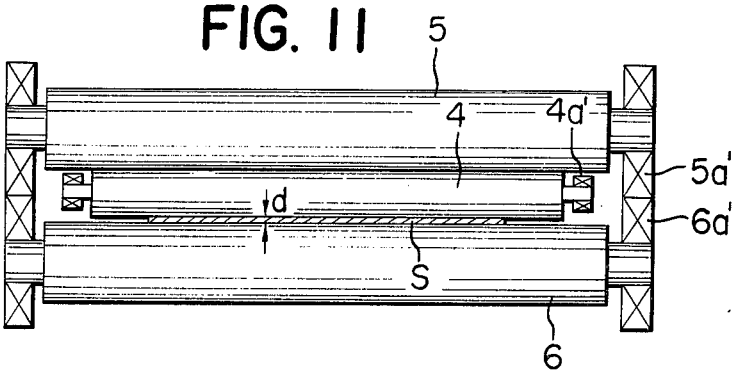

In the embodiment shown in FIG. 11, the bearing 5*a*′ for supporting the upper pressing roller 5 and the bearing 6*a*′ of the lower pressing roller 6 are in contact with each other so as to provide a gap d between the lower pressing roller 6 and the first roller 4 supported by a bearing 4*a*′.

Figure 12:
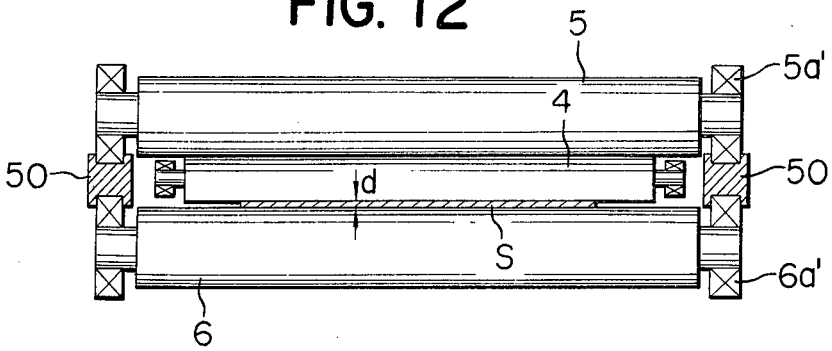

In the modification shown in FIG. 12, there is provided a spacer 50 between the bearings 5*a*′ and 6*a*′ to provide a space d.

Provision of such space or gap d between the first roller 4 and the lower pressing roller 6 or 106 serves to lessen the shock possibly produced at the time when the image supporting member S enters and leaves the nip portion between the two rollers.

Figure 13:
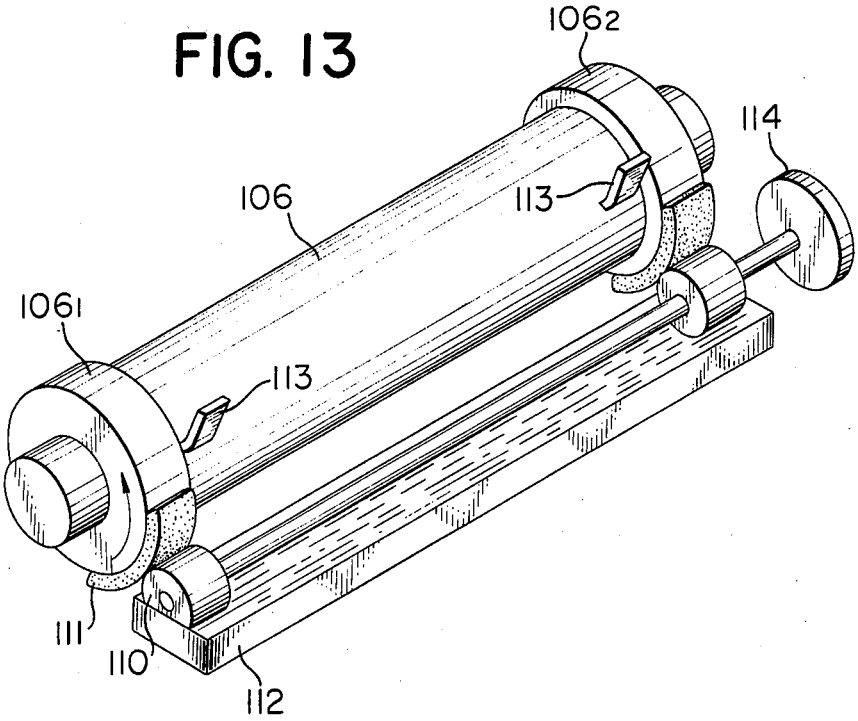

The embodiment shown in FIG. 13 is featured by a lubricant applying device provided for the lower pressing roller 106 shown in FIG. 10. Liquid lubricant contained in a reservoir 112 is applied to the flange portions $106_1$ and $106_2$ of the pressing roller 106 through a lubricant applying roller 110 and felt pads 111, 111 provided between the lubricant applying roller and the flange portions of the pressing roller. As lubricant, there may be used, for example, silicone oil which serves also as a surface lubricant for toner. A pair of blades 113 are provided to prevent the lubricant applied to the flange portions from flowing into the central portion of the roller 106. The lubricant applying roller 110 is driven by a driving source 114. To prevent the flow of lubricant into the central portion of the pressing roller 106, there may be provided at least one slot having a profile of U or V in the area between each the flange portion and the central portion on the circumferential surface of the roller 106. The lubricant applying device described above can provide an effective protection against friction for the flange portions to which a higher load is applied as compared to the remaining portion of the roller.

In all of the embodiments described above, the first roller and the pressing roller intersecting the first roller contact with each other to form a linear contact line. Therefore, the image supporting member can pass through the contact portion without being creased and can be transported always in a stable state. The effect on the prevention of creasing becomes remarkable in particular when a toner image supporting member of larger size in width is used.

Since, as previously noted, the three centers of the rollers in any cross section thereof lie on a straight line, it is allowed to apply to the toner image supporting member a relatively high and uniformly distributed load. This in turn allows for reducing the size of the first roller and the pressing rollers as compared to those of the known apparatus and to reduce the total pressure to be applied to each the roller. It is no longer necessary to use a large pressing mechanism and therefore it is possible to make a fixing apparatus small in size and light in weight as a whole. According to the above feature of the present invention, reduction of weight by some 40% as compared with the conventional ones is easily attainable.

Furthermore, contrary to the case of conventional pressure fixing apparatus which may cause the toner image supporting sheet to become too much brightened or translucent, the fixing apparatus according to the invention allows the supporting member to maintain its resiliency, good surface appearance and softness even after fixing and therefore to give a fixed image which is very easy to see.

Figure 14:
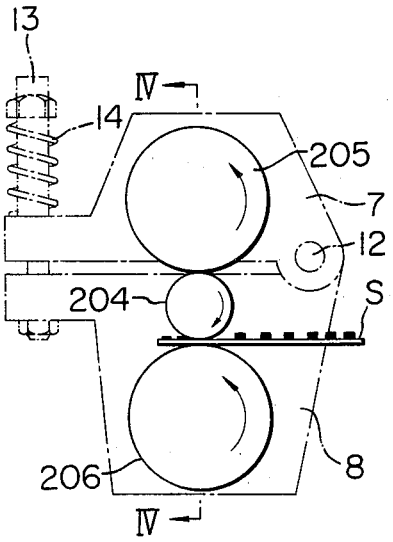
FIG. 14 shows a further embodiment of the invention.

FIG. 14 shows another preferred embodiment of the invention.

In FIG. 14, numeral 204 designates a first roller made from a hard metal material. 205 and 206 are pressing rollers also made from hard metal material and disposed in contact with the circumferential surface of the first roller. The first roller 204 is formed as a cylindrical roller having a constant diameter along its length as shown in FIG. 15.

One of the pressing rollers, that is, the roller 205 is formed as a crown roller the diameter of which gradually increases toward the middle portion from the both ends of the roller. The other pressing roller 206 is formed as a cylindrical roller having a uniform diameter throughout the length of the roller. The average diameter of the roller 205 and the diameter of the roller 206 are larger than the diameter of the first roller 204.

Figure 15:
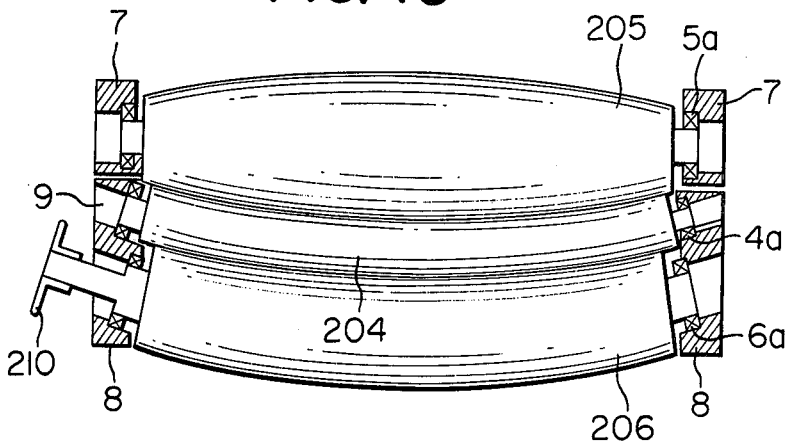
FIG. 15 is a section thereof taken along the line IV—IV in FIG. 14.

When these rollers are brought into such pressure contact relation as to produce a uniformly distributed load between the first roller 204 and the pressing roller 206, the axes of the two rollers 204 and 206 are deflected as illustrated in FIG. 15. The shape of the upper pressing roller 205 in a form of crown roller is determined to accommodate the deflection of the axes of the rollers 204 and 206.

Figure 16:
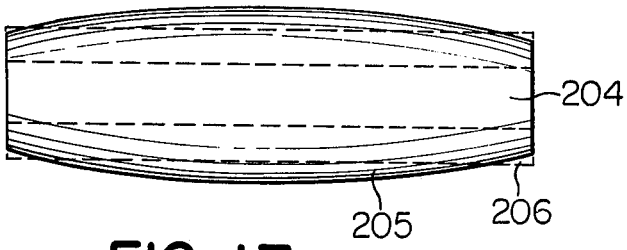
FIG. 16 is a plane thereof showing the arrangement of the rollers.

The three rollers 204, 205 and 206 are so disposed that when no pressure is applied to them, the center axes of the three rollers may extend parallel to each other as seen in FIG. 16, which is different from the embodiments previously described. It is not impossible to dispose these three rollers in such manner that the center axes of the three rollers are not in parallel to each other but intersect each other at a certain angle. However, in this case it becomes very difficult and troublesome to determine the angle of intersection and to mount the rollers properly.

Figure 17:
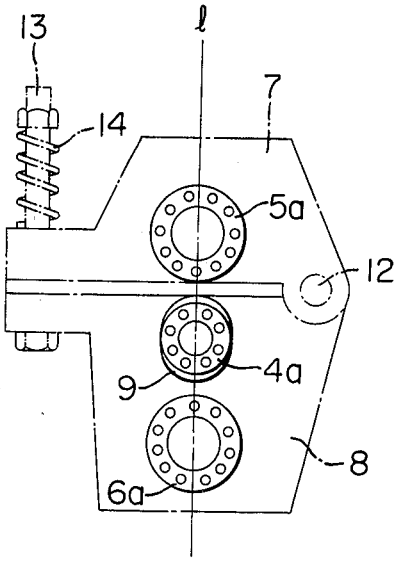
FIG. 17 is a side view thereof.

As shown in FIGS. 15 and 17, the upper pressing roller 205 is rotatably mounted on a pair of upper supporting plates 7 through a bearing **5*a* and the lower pressing roller 205 is mounted rotatably on a pair of supporting plates 8 through a bearing 6*a*. Also, the first roller 204 is mounted rotatably on the supporting plates 8 through a bearing 4*a*. These rollers are positioned in such manner that when they are under the action of pressure, the center axes of the three rollers 204, 205 and 206 in any cross section thereof can always lie on a straight line l. This arrangement of the rollers has several advantages. It allows to apply to a toner image supporting member S a load uniformly distributed thereon. When the first roller 204 is held sandwiched in between the two pressing rollers 205 and 206**, the above described arrangement prevents the first roller from slipping out from its position or from being bent by the shock possibly produced at the time when the image supporting member S comes in and out from the roller.

In order to assure an application of load uniformly distributed over the surface of the image supporting member S, the first roller 204 is supported movably in a short distance also in a direction parallel with the straight line l on the support plate 8.

The supporting member S which may be a sheet of paper having thereon a toner image is fed into the nip portion between the first roller 204 and the pressing roller 206 with its toner image side being in contact with the first roller. To drive the fixing apparatus, there is provided at one end of the lower pressing roller 206 a sprocket 210 operatively connected to a driving source (not shown). When the lower pressing roller is rotated by the driving sprocket, the first roller 204 and the upper pressing roller 205 are driven into rotation through the rotation of the lower pressing roller 206. Alternatively, the sprocket may be provided at one end of the first roller 204.

The effect of the fixing apparatus shown in FIG. 14 on the fixability of toner image will be described hereinafter.

The upper pressing roller 205 of the pressure fixing apparatus shown in FIG. 14 is formed as a crown roller by the action of which there is produced a uniformly distributed load between the first roller 204 and the lower pressing roller 206 both of which are formed as cylindrical rollers. As already described, the first roller 204 and the lower pressing roller 206 with which the image supporting member S comes into contact, are deflected as illustrated in FIG. 15. However, with the arrangement of this embodiment there occurs no variation of peripheral speed along the length of the rollers although they are deflected by the crown roller. This means that during fixing the rollers 204 and 206 never apply any unreasonable force to the image supporting member S so that creasing or breaking of the supporting member can be prevented.

Figure 18:
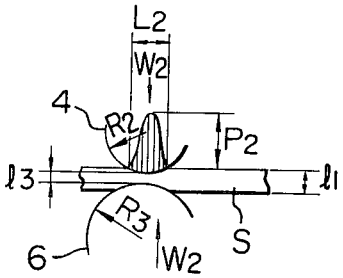
FIG. 18 shows the distribution of the pressure applied to the apparatus shown in FIG. 14.

FIG. 18 shows the distribution of pressure obtained from an experiment on the fixing apparatus shown in FIG. 14. In FIG. 18, the radius $R_2$ of the first roller 204 was 10 mm, the radius $R_3$ of the pressing roller 206 was 20 mm (the upper roller 205 was in a form of crown roller), total pressure $W_2$ was 20 kg/cm$^2$ (as linear pressure) and the thickness of copy sheet during pressing $l_3$ was 30μ. Under the condition, it was found that the nip width $L_2$ was 1.3 mm and the maximum local pressure $P_2$ was 270 kg/cm$^2$.

From the above result of experiment it is seen that the fixing apparatus according to the invention in which pressing rollers having a larger diameter than that of the first roller are used, enables application of a higher load onto a toner image supporting member with a lower total pressure as compared to the conventional ones and thereby a substantial improvement in fixability of toner image can be attained.

As previously noted, the supporting member having a toner image fixed with the apparatus according to the invention is free from crease and maintains good resiliency, appearance and softness. The fixed toner image is clear and very easy to see. Since the pressure load is uniformly applied onto the surface of the image supporting member, there occurs no irregularity of fixing. The image supporting member subjected to fixing never becomes brighter or semi-transparent, which is often caused with the conventional pressure fixing apparatus.

While the invention has been particularly shown and described with reference to preferred embodiments thereof, it will be understood by those skilled in the art that the foregoing and other changes in form and details can be made therein without departing from the spirit and scope of the invention.

What we claim is:

1. A pressure fixing apparatus wherein a toner image is fixed on a toner image supporting member by pressure, said apparatus comprising:

first and second rollers for pressing and conveying therebetween the toner supporting member; and a third roller press-contacted to said first roller;

said first, second and third rollers being inclined with respect to the direction of conveyance of the supporting member at different angles to make those parts of said first and second rollers which are in contact with the supporting member when the supporting member is pressed therebetween substantially rectilinear substantially in the direction of the axes of the rollers.

2. A fixing apparatus according to claim 1 wherein said first, second and third rollers are so disposed that at any axial cross-section the centers of said three rollers lie substantially along a line.

3. A fixing apparatus according to claim 2, wherein said first roller is movable in the direction of said line.

4. A fixing apparatus according to claims 1, 2 or 3, wherein said first, second and third rollers are so supported as to directly contact each other and are brought into a pressure contact relation by pressing means.

5. A fixing apparatus according to claims 1, 2 or 3, wherein said first and third rollers are in direct contact and said first and second rollers are so supported as to provide a space therebetween at least at the portion where said toner image supporting member contacts with said first and second rollers.

6. A fixing apparatus according to claim 5, wherein the size of said space is smaller than the thickness of said toner image supporting member deformed during fixing and larger than the maximum particle size of toner.

7. A fixing apparatus according to claim 5, wherein said second roller has flanges at both end portions which has a diameter larger than that of the central portion at which said toner image supporting member contacts with said second roller so that said central portion of said second roller is spaced from said first roller by said flanges.

8. A fixing apparatus according to claim 7, wherein said apparatus further comprises means for applying lubricant to said flanges.

9. A fixing apparatus according to claim 1, wherein said first, second and third rollers are made from hard material.

10. A fixing apparatus according to claim 9, wherein said second and third rollers are made from the same material and have different diameters.

11. A fixing apparatus according to claim 1, wherein said third roller is of such shape that its diameter varies from either end to the middle portion of said roller.

12. A pressure fixing apparatus wherein a toner image is fixed on a toner image supporting member by pressure, said apparatus comprising:

first and second rollers for pressing and conveying therebetween the toner supporting member, said first roller having a diameter smaller than that of said second roller; and a third roller press-contacted to said first roller and having a diameter which gradually reduces toward its longitudinal ends away from its middle portion.

13. A fixing apparatus according to claim 12, wherein said first, second and third rollers are inclined with respect to the direction of conveyance of the supporting member at different angles, and wherein the three rollers are so disposed that, at any axial cross-section, their centers lie substantially on a line.

14. A fixing apparatus according to claim 13, wherein said first roller is movable in the direction of said line.

15. A fixing apparatus according to claims 12, 13 or 14, wherein said first, second and third rollers are made from hard material.

16. A fixing apparatus according to claim 12, wherein said third roller is formed as a crown roller which has a larger diameter at its middle portion than that at the end portion.

17. A pressure fixing apparatus wherein a toner image is fixed on a toner image supporting member by pressure, said apparatus comprising:

first and second rollers for pressing and conveying therebetween the toner supporting member; and a third roller press-contacted to said first roller;

said first, second and third rollers being inclined with respect to the direction of conveyance of the supporting member, and said first, second and third rollers being so disposed that, at any axial cross-section, the centers of said three rollers lie substantially along a line, the lines at various cross-sections intersecting a common line between said first and second rollers.

18. An apparatus according to claim 17, wherein said first roller has a diameter smaller than that of said second and third rollers.

19. An apparatus according to claim 18, wherein said second and third rollers are identical except that the diameters thereof are different.

20. An apparatus according to claim 18, wherein said second and third rollers are different type rollers but have equal diameters.

* * * * *